US009649006B2

(12) United States Patent
Dries

(10) Patent No.: US 9,649,006 B2
(45) Date of Patent: May 16, 2017

(54) FLUID CIRCULATION SYSTEM FOR DISHWASHER APPLIANCES

(71) Applicant: General Electric Company, Schenectady, NY (US)

(72) Inventor: John Edward Dries, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 79 days.

(21) Appl. No.: 14/860,806

(22) Filed: Sep. 22, 2015

(65) Prior Publication Data

US 2017/0079503 A1 Mar. 23, 2017

(51) Int. Cl.
*A47L 15/42* (2006.01)
*A47L 15/22* (2006.01)

(52) U.S. Cl.
CPC ..... *A47L 15/4208* (2013.01); *A47L 15/22* (2013.01); *A47L 15/4206* (2013.01); *A47L 15/4221* (2013.01)

(58) Field of Classification Search
CPC ..... A47L 15/4208
See application file for complete search history.

(56) References Cited

U.S. PATENT DOCUMENTS

| | | | |
|---|---|---|---|
| 8,603,255 | B2 | 12/2013 | Classen et al. |
| 2006/0237050 | A1 | 10/2006 | Weaver et al. |
| 2014/0109938 | A1 | 4/2014 | Geda et al. |

FOREIGN PATENT DOCUMENTS

| | | | |
|---|---|---|---|
| DE | 10244242 | | 3/2004 |
| DE | 10244243 | | 3/2004 |
| EP | 0898928 | A1 * | 3/1999 |

* cited by examiner

*Primary Examiner* — Michael Barr
*Assistant Examiner* — Jason Riggleman
(74) *Attorney, Agent, or Firm* — Dority & Manning, P.A.

(57) ABSTRACT

Fluid circulation systems for dishwasher appliances are provided. A fluid circulation system includes a sump and a pump. The fluid circulation system further includes a filter at least partially disposed within a chamber of the sump and surrounding an impeller of the pump, and an outlet conduit for flowing fluid from the sump to a wash chamber. The fluid circulation system further includes a manifold disposed proximate an outer surface of a sidewall of the filter, the manifold defining a plurality of apertures for flowing fluid therethrough and towards the outer surface of the sidewall of the filter, and a valve disposed within the outlet conduit, the valve movable between a first position wherein fluid flowed through the valve is exhausted from the valve into the outlet conduit and towards the wash chamber and a second position wherein fluid flowed through the valve is diverted to the manifold.

20 Claims, 5 Drawing Sheets

FLUID CIRCULATION SYSTEM FOR DISHWASHER APPLIANCES

FIELD OF THE INVENTION

The subject matter of the present disclosure relates generally to dishwasher appliances, and more particularly to fluid circulation systems with improved filtration in dishwasher appliances.

BACKGROUND OF THE INVENTION

Dishwasher appliances generally include a tub that defines a wash compartment. Rack assemblies can be mounted within the wash chamber of the tub for receipt of articles for washing. Spray assemblies within the wash chamber can apply or direct wash fluid towards articles disposed within the rack assemblies in order to clean such articles. Multiple spray assemblies can be provided including e.g., a lower spray arm assembly mounted to the tub at a bottom of the wash chamber, a mid-level spray arm assembly mounted to one of the rack assemblies, and/or an upper spray assembly mounted to the tub at a top of the wash chamber. Other configurations may be used as well.

Dishwasher appliances further typically include a fluid circulation system which is in fluid communication with the spray assemblies for circulating fluid to the spray assemblies. The fluid circulation system generally receives fluid from the wash chamber, filters soil from the fluid, and flows the filtered fluid to the spray assemblies. Additionally, unfiltered fluid can be flowed to a drain as required.

Some known fluid circulation systems utilize a large, flat, coarse filter and a cylindrical fine filter to filter soil. These filters are generally horizontally positioned within the fluid circulation system, and fluid typically flows through either the coarse or the fine filter as it is flowed towards a pump of the fluid circulation system for recirculation.

More recently, improved filter arrangements have been utilized. These filters have perforated sidewalls which are generally vertically positioned and, for example, cylindrical. A pump is at least partially disposed within such a filter. Generally all wash fluid flowed to the pump is flowed through the filter. Such filter arrangements generally provide improved filtering and fluid flow relative to previously known filter arrangements.

However, some issues remain with such improved filter arrangements. For example, a fundamental issue with filters is that they must remain sufficiently clear to allow fluid to flow therethrough. Excess soil that remains on the filter can block such fluid flow. Accordingly, cleaning of the filter to prevent such blockages during operation is desired. One solution is to actively spray fluid at the filter to remove the soil therefrom. However, known arrangements which provide such active spraying constantly divert fluid from the spray assemblies and require that significantly more water is utilized during operation of the dishwasher appliance. The resulting increase in energy and water usage decreases the efficiency of the dishwasher appliance and is thus undesirable.

Accordingly, improved fluid circulation systems for dishwasher appliances are desired. In particular, fluid circulation systems which provide improved fluid filtering, and in particular improved filter cleaning during dishwasher appliance operation, would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a fluid circulation system for a dishwasher appliance is provided. The dishwasher appliance includes a tub that defines a wash chamber. The fluid circulation system includes a sump for receiving fluid from the wash chamber, the sump including a chamber having a sidewall and a base wall. The fluid circulation system further includes a pump, the pump including an impeller disposed within the chamber. The fluid circulation system further includes a filter at least partially disposed within the chamber and surrounding the impeller, the filter including a sidewall having an inner surface and an outer surface, the sidewall defining a plurality of perforations extending therethrough. The fluid circulation system further includes an outlet conduit for flowing fluid from the sump to the wash chamber, the outlet conduit in fluid communication with the pump for receiving fluid from the pump. The fluid circulation system further includes a manifold disposed proximate the outer surface of the sidewall of the filter, the manifold defining a plurality of apertures for flowing fluid therethrough and towards the outer surface of the sidewall of the filter. The fluid circulation system further includes a valve disposed within the outlet conduit, the valve movable between a first position wherein fluid flowed through the valve is exhausted from the valve into the outlet conduit and towards the wash chamber and a second position wherein fluid flowed through the valve is diverted to the manifold.

In accordance with another embodiment, a dishwasher appliance is provided. The dishwasher appliance includes a cabinet defining an interior, a tub disposed within the interior and defining a wash chamber for the receipt of articles for cleaning, and a fluid circulation system. The fluid circulation system includes a sump for receiving fluid from the wash chamber, the sump including a chamber having a sidewall and a base wall. The fluid circulation system further includes a pump, the pump including an impeller disposed within the chamber. The fluid circulation system further includes a filter at least partially disposed within the chamber and surrounding the impeller, the filter including a sidewall having an inner surface and an outer surface, the sidewall defining a plurality of perforations extending therethrough. The fluid circulation system further includes an outlet conduit for flowing fluid from the sump to the wash chamber, the outlet conduit in fluid communication with the pump for receiving fluid from the pump. The fluid circulation system further includes a manifold disposed proximate the outer surface of the sidewall of the filter, the manifold defining a plurality of apertures for flowing fluid therethrough and towards the outer surface of the sidewall of the filter. The fluid circulation system further includes a valve disposed within the outlet conduit, the valve movable between a first position wherein fluid flowed through the valve is exhausted from the valve into the outlet conduit and towards the wash chamber and a second position wherein fluid flowed through the valve is diverted to the manifold.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
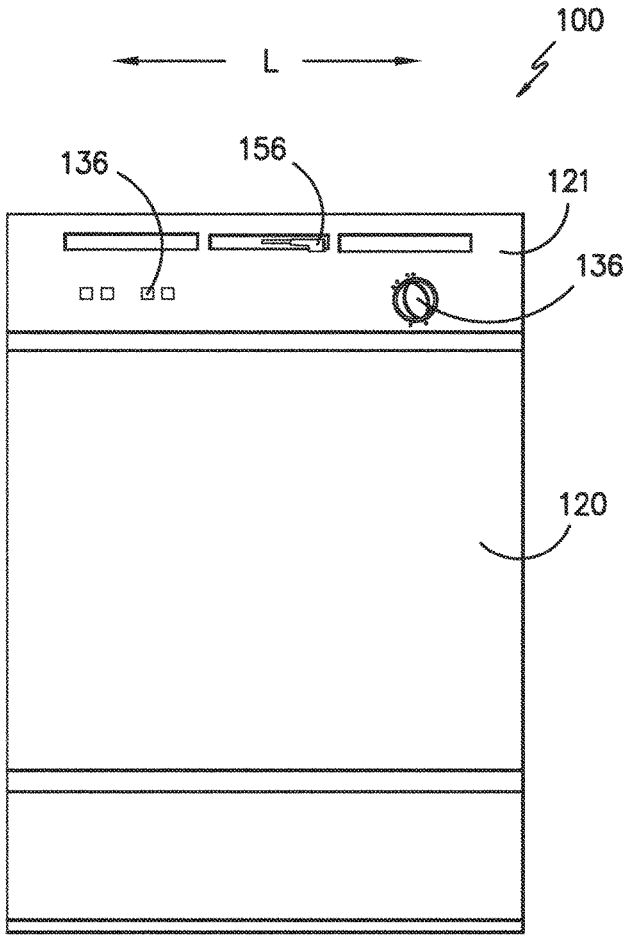
FIG. 1 provides a front view of a dishwasher appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

Figure 2:
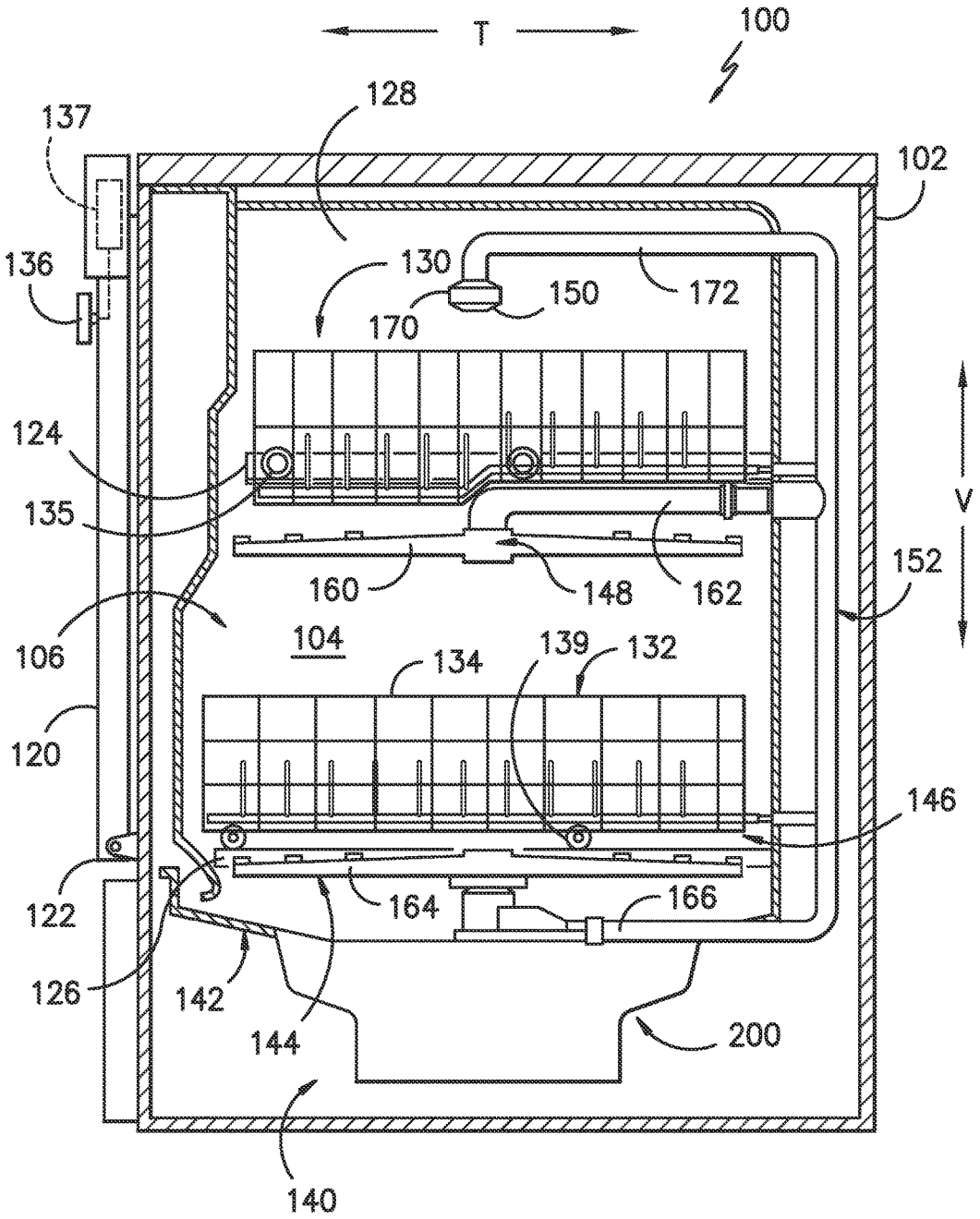
FIG. 2 provides a side, cross-sectional view of a dishwasher appliance in accordance with one embodiment of the present disclosure.

FIGS. 1 and 2 depict an exemplary domestic dishwasher appliance 100 that may be configured in accordance with aspects of the present disclosure. For the particular embodiment of FIGS. 1 and 2, the dishwasher appliance 100 includes a cabinet 102 having a tub 104 therein that defines a wash chamber 106. As shown, the dishwasher appliance 100 (such as the cabinet 102 thereof) defines a vertical direction V, a lateral direction L, and a transverse direction T, which are mutually orthogonal and define a coordinate system for the dishwasher appliance. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. A latch 156 may be used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher appliance 100 further includes a lower spray-arm assembly 144 that is rotatably mounted within a lower region 146 of the wash chamber 106 and above a bottom wall 142 of the tub 104 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

Each spray arm-assembly 144 may include a spray arm and a conduit in fluid communication with the spray arm, for providing a fluid flow to the spray arm. For example, mid-level spray-arm assembly 148 may include a spray arm 160 and a conduit 162. Lower spray-arm assembly 144 may include a spray arm 164 and a conduit 166. Additionally, upper spray assembly 150 may include a spray head 170 and a conduit 172 in fluid communication with the spray head 170.

The lower and mid-level spray-arm assemblies 144, 148 and the upper spray assembly 150 are part of a fluid circulation system 152 for circulating fluid in the dishwasher appliance 100. The fluid circulation system 152 also includes various components for receiving fluid from the wash chamber 106, filtering the fluid, and flowing the fluid to the various spray assemblies such as the lower and mid-level spray-arm assemblies 144, 148 and the upper spray assembly 150. As discussed herein such components can be generally positioned within a machinery compartment 140 below the bottom wall 142 and in communication with the wash chamber 106.

The dishwasher appliance 100 is further equipped with a controller 137 to regulate operation of the dishwasher appliance 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different combinations of spray assemblies may be utilized, and other differences may be applied as well.

Figure 3:
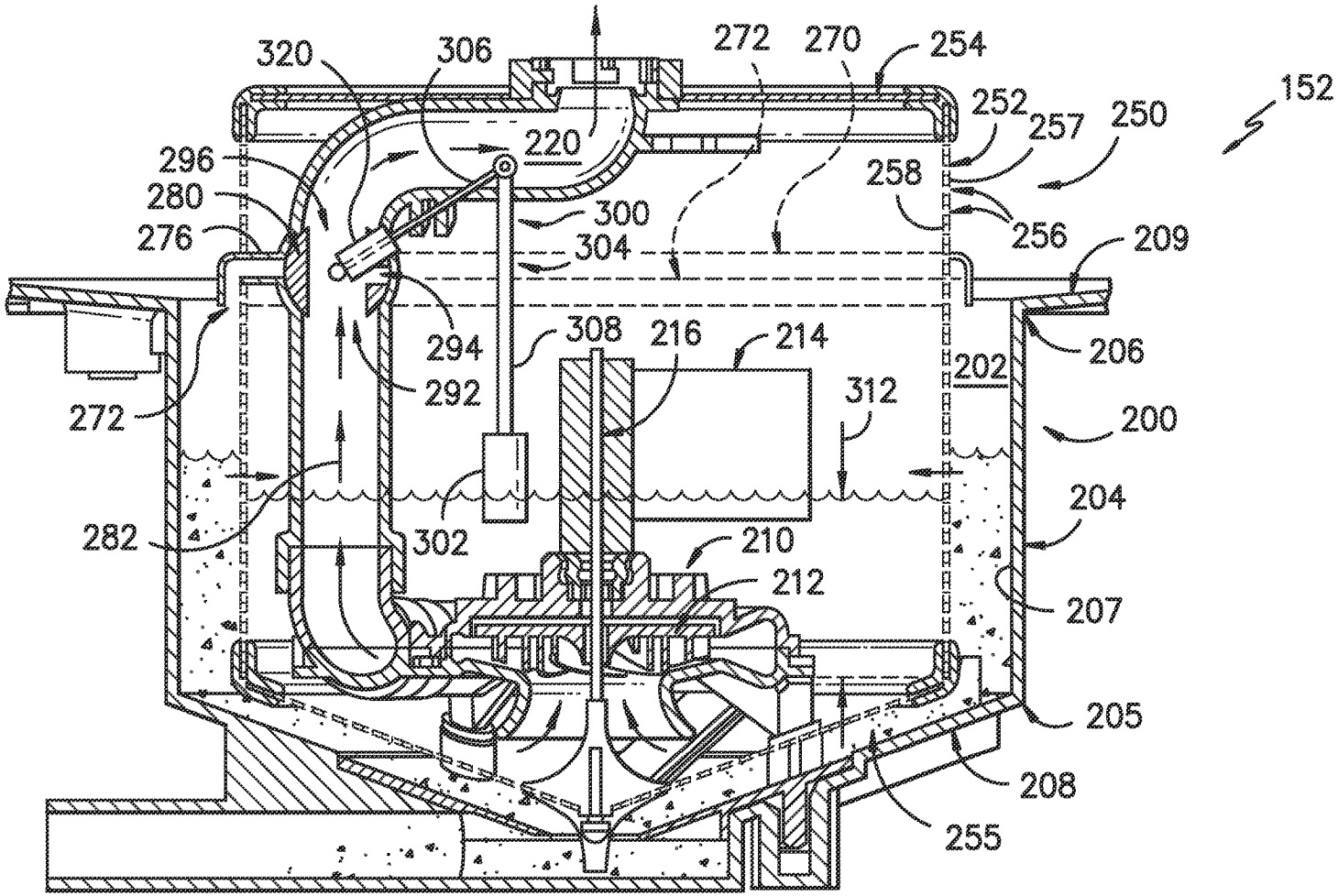
FIG. 3 provides a cross-sectional view of a fluid circulation system for a dishwasher appliance with a valve in a first position in accordance with one embodiment of the present disclosure.
Figure 4:
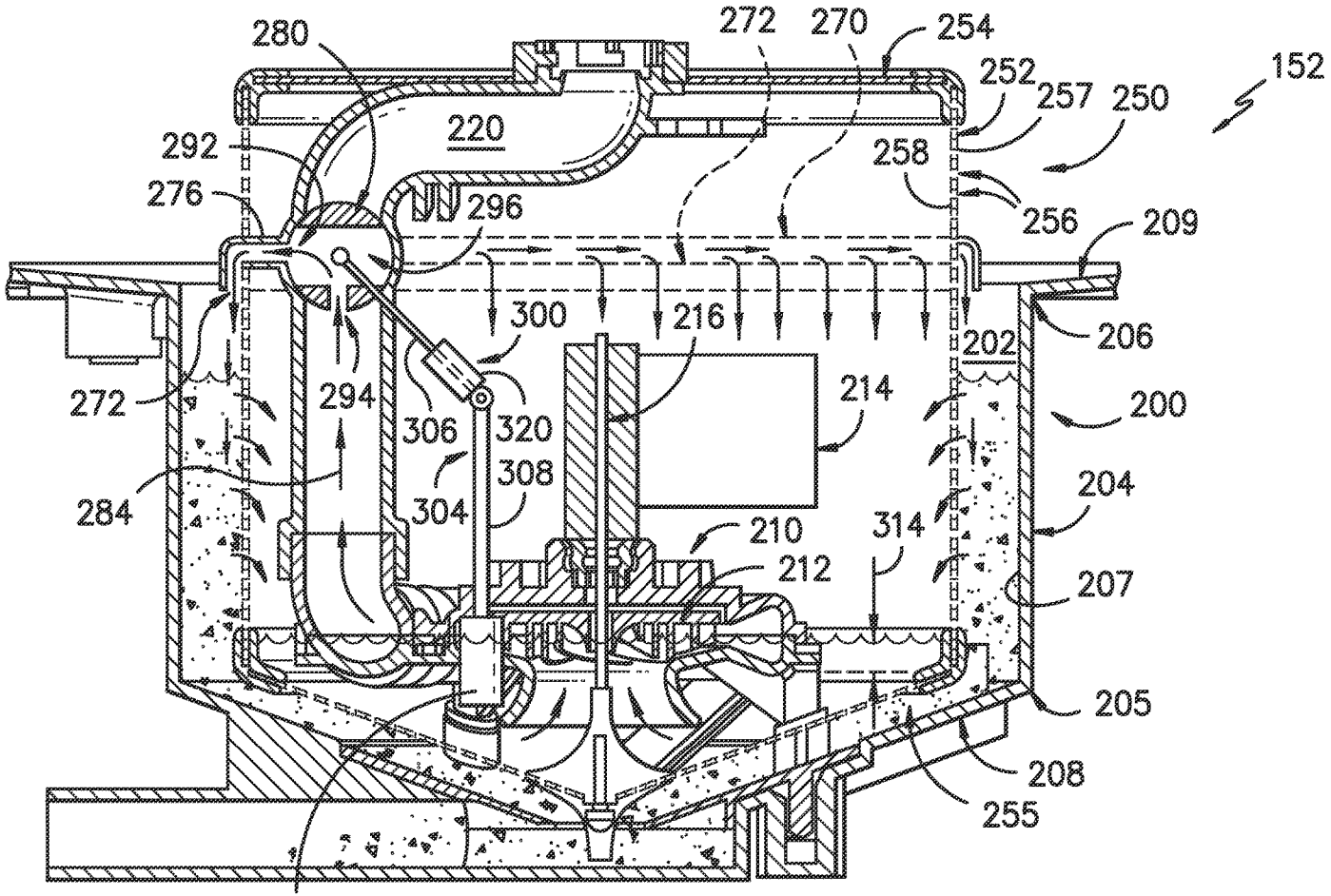
FIG. 4 provides a cross-sectional view of a fluid circulation system for a dishwasher appliance with a valve in a second position in accordance with one embodiment of the present disclosure.
Figure 5:
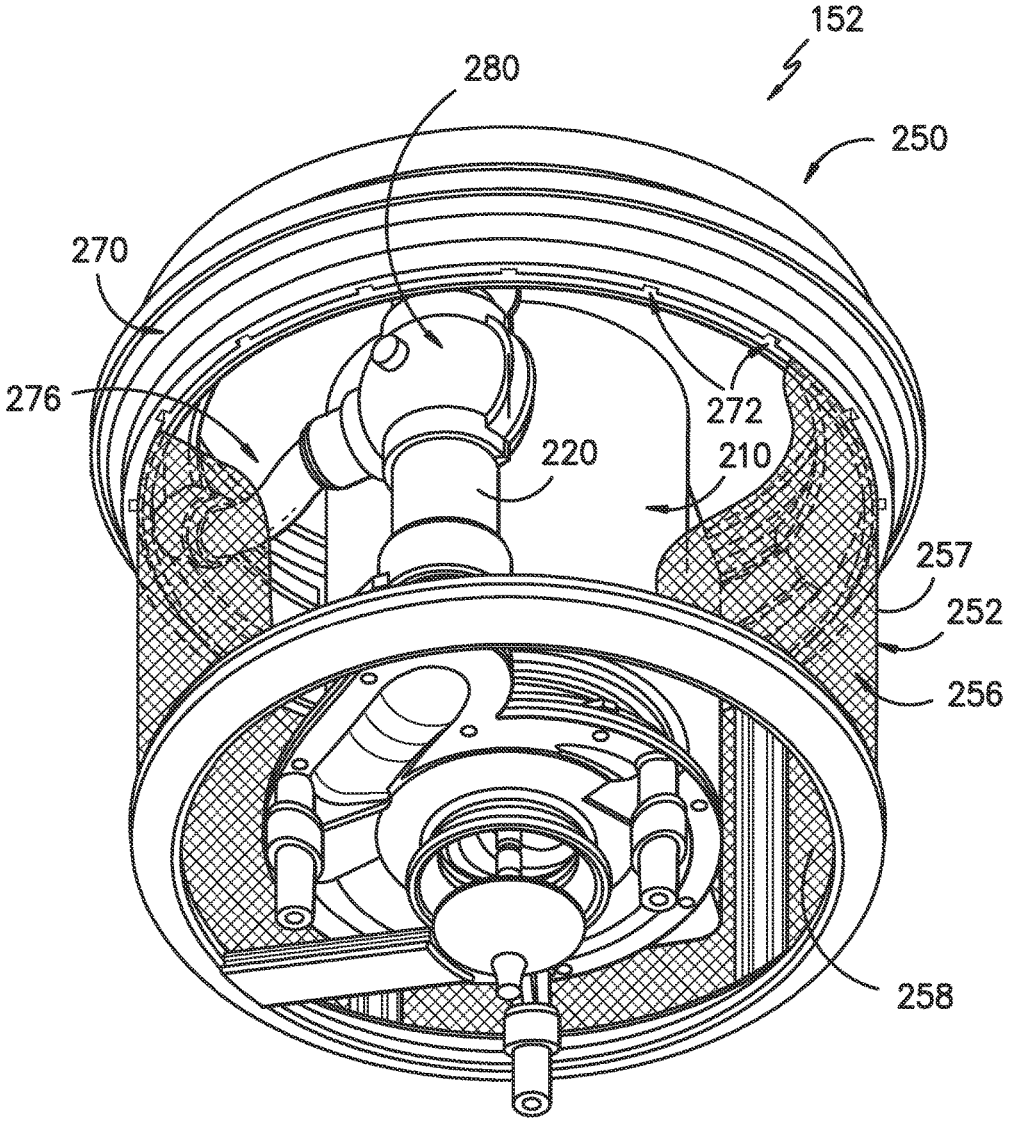
FIG. 5 provides a perspective view of components of a fluid circulation system for a dishwasher appliance in accordance with one embodiment of the present disclosure.

Referring now to FIGS. 3 through 5, embodiments of portions of the fluid circulation system 152 of a dishwasher appliance 100 are illustrated. As shown, system 152 may include, for example, a sump 200 for receiving fluid from the wash chamber 106. The sump 200 may be mounted to the bottom wall 142 and extend into the machinery compartment 140, and fluid may for example flow from the bottom wall 142 into the sump 200.

Sump 200 may include and define, for example, a chamber 202 which receives the fluid from the wash chamber 106. As illustrated, sump 200 may include a sidewall 204 and a base wall 208 which define the chamber 202. For example, an inner surface 207 of the sidewall 204 may defined the chamber 202. The sidewall 204 may extend from the base wall 208, such as generally along the vertical direction V (i.e. within 10 degrees of vertical). In some embodiments, the sidewall 204 may have a generally circular cross-sectional shape. Alternatively, the sidewall 204 may have a generally rectangular or other suitable polygonal cross-sectional shape, with multiple linear or curvilinear cross-sectional portions. Sidewall 204 may extend between a bottom end 205 (which may be connected to the base wall 208) and a top end 206 (which may be distal from the base wall 208 along the vertical direction V).

Sump 200 may additionally include a skirt 209. The skirt 209 may extend from the sidewall 204, such as from the top end 206, away from the chamber 202 and away from a filter 250 disposed at least partially within the chamber 202 (as discussed herein). For example, the skirt 209 may extend generally perpendicularly (i.e. within 10 degrees of radial) to sidewall 204 and/or generally radially (i.e. within 10 degrees of radial) from the sidewall 204. Fluid flowing into the chamber 202 may flow along skirt 209 until the skirt 209 reaches the sidewall 204, and the fluid may then flow into the chamber 202. Skirt 209 may, for example, be mounted to bottom wall 142.

System 152 may further include a pump 210. Pump 210 may include an impeller 212 which is disposed within the chamber 202. Pump 210 may further include a motor 214 and a shaft 216 which connects the motor 214 and impeller 212. For example, the motor 214 may be disposed within the chamber 202, and may be hermetically sealed to prevent damage thereto from fluids within the chamber 202. Alternatively, the shaft 216 may extend through the base wall 208, and the motor 214 may be external to the chamber 202. Impeller 212 may spin within the chamber 202 when activated by the motor 214 to influence the flow of fluid within the chamber 202.

System 152 may further include one or more outlet conduits 220. An outlet conduit 220 flows fluid from the sump 200, such as from the chamber 202 thereof, to the wash chamber 106, such as via one or more of the spray assemblies. For example, outlet conduit 220 may be connected to and in fluid communication with one or more of the various spray assemblies, such as the lower and mid-level spray-arm assemblies 144, 148 and the upper spray assembly 150, such that fluid flowed into the outlet conduit 220 can flow to these spray assemblies. Outlet conduit 220 may be in fluid communication with the pump 210, such that flow flowed through the impeller 212 flows into the outlet conduit(s) 220 towards the spray assemblies and thus the wash chamber 106. In the embodiment illustrated, for example, conduit 220 is in fluid communication at least with lower spray arm assembly 144.

As further illustrated, a filter 250 may be disposed at least partially within the chamber 202. As shown, the filter 250 surrounds the impeller 212, and can additionally surround other components of the pump 210 such as the motor 214. As illustrated, a filter 250 in accordance with the present disclosure may include a sidewall 252. Filter 250 may further include a top wall 254, through which the outlet conduit 220 extends. Still further, filter 250 may include a base wall 255. The sidewall 252 may extend generally along the vertical direction V (i.e. within 10 degrees of vertical) and between the top wall 254 and bottom wall 255. In some embodiments, the sidewall 252 may have a generally circular cross-sectional shape, as illustrated in FIG. 3. Alternatively, the sidewall 252 may have a generally rectangular or other suitable polygonal cross-sectional shape, with multiple linear or curvilinear cross-sectional portions.

As further illustrated, the sidewall 252 may define a plurality of perforations 256 extending therethrough, such as between an outer surface 257 and an inner surface 258 of the sidewall 252. The perforations 256 may be sized and shaped to allow fluid flow therethrough, while preventing the flow of soil therethrough, thus filtering the fluid as it flows into the filter 250 through the walls thereof. Each perforation 256 may have any suitable shape, such as a generally circular cross-sectional shape, a generally rectangular cross-sectional shape, or other suitable polygonal cross-sectional shape.

As further illustrated, system 152 may further include a manifold 270. The manifold may be configured to provide fluid to the outer surface 257 of the filter sidewall 252 for cleaning of the sidewall 252. In particular, fluid flowing through the outlet conduit 220 may, as discussed herein, be diverted to the manifold 270. The fluid in the manifold 270 may then be flowed from the manifold 270 towards and onto the outer surface 257. The flow of fluid onto and on the outer surface 257 may advantageously clean the sidewall 252 by dislodging and removing soil from the sidewall 252. In exemplary embodiments, the fluid exhausted from the manifold 270 may be exhausted in a plurality of streams, which may for example, be relatively high velocity jets of fluid, towards the outer surface 257. The fluid may, for example, be exhausted generally along the vertical direction V onto the outer surface 257, and may flow generally along the vertical direction V to clean the sidewall 252.

Manifold 270 may be disposed proximate the outer surface 257, and may for example wrap around at least a portion of the perimeter of the sidewall 252. As illustrated, manifold 270 may for example contact the outer surface 257. Further, in exemplary embodiments, manifold 270 may be disposed proximate the top wall 254. A plurality of apertures 272 may be defined in the manifold 270 for flowing fluid therethrough. Each aperture 272 may be oriented to direct fluid exhausted therefrom towards the outer surface 257. For example, fluid exhausted from each aperture 272 may be flowed generally along the vertical direction V and along the outer surface 257.

System 152 may further include a valve 280. Valve 280 may be configured for selectively flowing fluid to the wash chamber 106 (such as via one or more of the spray assemblies) or to the manifold 270, depending on the position of the valve 280. Use of such a valve 280 in accordance with the present disclosure may advantageously provide improved cleaning of the filter 250 without requiring an increase in water usage or an increase in energy usage or motor size. Such improved cleaning is provided by, for example, selective diversion of the fluid to the manifold 270 for periodic amounts of time to clean the filter 250, such as the sidewall 252 thereof, as needed. Further, as discussed herein, the valve 280 may advantageously only be utilized to divert fluid to the manifold 270 when cleaning is needed, and may automatically select between flowing fluid to the wash chamber 106 (such as via one or more of the spray assemblies) or to the manifold 270.

Valve 280 may, for example, be disposed within the outlet conduit 220. Valve 280 may be movable and moved, such as in exemplary embodiments rotatable and rotated as illustrated, between a first position and a second position. In the first position, as illustrated in FIG. 3, fluid flowed through the valve 280 is exhausted from the valve 280 into the outlet conduit 220 downstream of the valve 280 and towards the wash chamber 104 (i.e. via one or more spray assemblies). In the second position, as illustrated in FIG. 4, fluid flowed through the valve 280 is diverted to the manifold 270, and is thus exhausted from the valve 280 towards the manifold 270. Further, in exemplary embodiments, fluid flow to the manifold 270 is restricted or prevented in the first position and fluid flow into the outlet 220 and towards the wash chamber 106 is restricted or prevented in the second position. Flow direction 282 illustrates the direction of flow of fluid when the valve 280 is in the first position, and flow direction 284 illustrates the direction of flow of fluid when the valve 280 is in the second position.

Valve 280 may, for example, define a plurality of openings for fluid flow therethrough. The various openings may route the fluid towards the manifold 270 or towards the wash chamber 106. For example, as shown, valve 280 may include a first opening 292, a second opening 294, and a third opening 296. When the valve 280 is in the first position, the first opening 292 may be a fluid inlet and the third opening 296 may be a fluid outlet, and fluid may thus flow therethrough. When the valve 280 is in the second position, the second opening 294 may be a fluid inlet and the first opening 292 as shown (or the third opening 296) may be a fluid outlet. Alternatively, other suitable valve arrangements may be utilized.

In exemplary embodiments, a diverter conduit 276 may be provided for flowing fluid to the manifold 270. The diverter conduit 276 may be in fluid communication with and between the valve 280 and the manifold 270, such that fluid can be flowed from the valve 280 through the diverter conduit 276 to the manifold 270. Accordingly, fluid flowed through the valve 280 may, when the valve 280 is in the second position, be exhausted from the valve 280 into the diverter conduit 276 and towards the manifold 270.

In exemplary embodiments, an actuator 300 may be utilized to move the actuator between the first and second positions, and may thus be operable to move the valve 280 between the first position and the second position. In some embodiments, actuator 300 may be an electronic actuator 300 which may, for example, include a processor. The electronic actuator 300 may, for example, transmit signals to the valve 280 to move the valve to the first position and to the second position as required.

Alternatively, as illustrated, actuator 300 may include a float 302 and a linkage assembly 304 which may include one or more linkages. For example, linkage assembly 304 may include a first linkage 306 and a second linkage 308, as illustrated. The first linkage 306 may be connected, such as fixedly connected, to the valve 280 and may rotate (and rotate with) the valve 280. The second linkage 308 may be connected to and between the first linkage 306 and the float 302, and may be rotatable relative to the first linkage 206 as shown. The float 302 may be buoyant in the fluid, and may thus float on the fluid. As illustrated, float 302 may be disposed within the filter 250.

In exemplary embodiments as shown, the valve 280 may move to the first position when a fluid level within the filter 250 is at a first height 312, and may move to the second position when a fluid level within the filter 250 is at a second height 314 that is less than the first height 312. The heights 312, 314 may be measured, for example, from the bottom of the sidewall 252 as shown, another suitable location on the sidewall 252, the base wall 255, the base wall 208, or any other suitable location within filter 250 or sump 200. The heights 312, 314 may correspond to different levels of cleanliness of the filter sidewall 252, and may thus serve as indicators of whether the sidewall 252 is in need of cleaning For example, when relatively less soil is lodged in perforations 256, fluid flow through the sidewall 252 may be relatively higher, and the height of fluid within the filter 250 may be at, for example, first height 312. However, as more soil becomes lodged in perforations 256, fluid flow through the sidewall 252 may be reduced, and the height of fluid within the filter 250 may be at, for example, lower height 314. The height of fluid in the filter 250 can thus be utilized as an indicator of whether sidewall cleaning 252 is required. When the fluid height is reduced to height 314, the valve 280 may thus be moved to the second position to facilitate cleaning via fluid flow from manifold 270. When the fluid height is above height 314, such as at height 312, the valve 280 may thus be moved to the first position to facilitate normal fluid flow to wash chamber 106.

Use of a float 302 can advantageously facilitate the use of differential heights 312, 314 to cause operation of the actuator 280. The float 302 may, for example, move with the fluid level. When the fluid moves from height 312 to height 314, the position of the float 302 may drop, causing the linkage assembly 304 to move, which may in turn cause the valve 280 to move from the first position to the second position. When the fluid moves from height 314 to height 312, the position of the float 302 may rise, causing the linkage assembly 304 to move, which may in turn cause the valve 280 to move from the second position to the first position.

Actuator 300 may, in some embodiments, further include a weight 320. Weight 320 may be movable, such as slidable, along a linkage of the linkage assembly 304. For example, as illustrated, weight 320 may be slidable along first linkage 306. Use of weight 320 may ensure that the actuator 300 does not get stuck at a steady state position between the first and second positions. For example, weight 320 may move to a position proximate the valve 280 when the valve 280 is in the first position, and may thus resist movement of the valve 280 to the second position until the positions of the float 302 and linkage assembly 304 cause the weight 320 to move to a position proximate the second linkage 308 and the valve 280 moves to the second position. In this position, the weight 320 may resist movement of the valve 280 to the first position until the positions of the float 302 and linkage assembly 304 cause the weight 320 to move to back to the position proximate the valve 280 and the valve 280 moves to the first position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A fluid circulation system for a dishwasher appliance, the dishwasher appliance comprising a tub that defines a wash chamber, the fluid circulation system comprising:

a sump for receiving fluid from the wash chamber, the sump comprising a chamber having a sidewall and a base wall;

a pump, the pump comprising an impeller disposed within the chamber; and a filter at least partially disposed within the chamber and surrounding the impeller, the filter comprising a sidewall having an inner surface and an outer surface, the sidewall defining a plurality of perforations extending therethrough;

an outlet conduit for flowing fluid from the sump to the wash chamber, the outlet conduit in fluid communication with the pump for receiving fluid from the pump;

a manifold disposed proximate the outer surface of the sidewall of the filter, the manifold defining a plurality of apertures for flowing fluid therethrough and towards the outer surface of the sidewall of the filter; and a valve disposed within the outlet conduit, the valve movable between a first position wherein fluid flowed through the valve is exhausted from the valve into the outlet conduit and towards the wash chamber and a second position wherein fluid flowed through the valve is diverted to the manifold.

2. The fluid circulation system of claim 1, wherein in the first position fluid flow to the manifold is restricted and in the second position fluid flow into the outlet conduit and towards the wash chamber is restricted.

3. The fluid circulation system of claim 1, further comprising a diverter conduit in fluid communication between the valve and the manifold, and wherein in the second position fluid flowed through the valve is exhausted from the valve into the diverter conduit.

4. The fluid circulation system of claim 1, wherein the valve is rotatable between the first position and the second position.

5. The fluid circulation system of claim 1, further comprising an actuator operable to move the valve between the first position and the second position.

6. The fluid circulation system of claim 5, wherein the actuator comprises a float and a linkage assembly.

7. The fluid circulation system of claim 6, wherein the linkage assembly comprises a first linkage and a second linkage, the first linkage connected to the valve, the second connected to and between the first linkage and the float.

8. The fluid circulation system of claim 6, wherein the float is disposed within the filter.

9. The fluid circulation system of claim 6, wherein the actuator further comprises a weight, the weight slidable along a linkage of the linkage assembly.

10. The fluid circulation system of claim 1, wherein the valve moves to the first position when a fluid level within the filter is at a first height and moves to the second position when a fluid level within the filter is at a second height that is less than the first height.

11. A dishwasher appliance, comprising:

a cabinet defining an interior;

a tub disposed within the interior and defining a wash chamber for the receipt of articles for cleaning; and a fluid circulation system, the fluid circulation system comprising:

a sump for receiving fluid from the wash chamber, the sump comprising a chamber having a sidewall and a base wall;

a pump, the pump comprising an impeller disposed within the chamber; and a filter at least partially disposed within the chamber and surrounding the impeller, the filter comprising a sidewall having an inner surface and an outer surface, the sidewall defining a plurality of perforations extending therethrough;

an outlet conduit for flowing fluid from the sump to the wash chamber, the outlet conduit in fluid communication with the pump for receiving fluid from the pump;

a manifold disposed proximate the outer surface of the sidewall of the filter, the manifold defining a plurality of apertures for flowing fluid therethrough and towards the outer surface of the sidewall of the filter; and a valve disposed within the outlet conduit, the valve movable between a first position wherein fluid flowed through the valve is exhausted from the valve into the outlet conduit and towards the wash chamber and a second position wherein fluid flowed through the valve is diverted to the manifold.

12. The dishwasher appliance of claim 11, wherein in the first position fluid flow to the manifold is restricted and in the second position fluid flow into the outlet conduit and towards the wash chamber is restricted.

13. The dishwasher appliance of claim 11, further comprising a diverter conduit in fluid communication between the valve and the manifold, and wherein in the second position fluid flowed through the valve is exhausted from the valve into the diverter conduit.

14. The dishwasher appliance of claim 11, wherein the valve is rotatable between the first position and the second position.

15. The dishwasher appliance of claim 11, further comprising an actuator operable to move the valve between the first position and the second position.

16. The dishwasher appliance of claim 15, wherein the actuator comprises a float and a linkage assembly.

17. The dishwasher appliance of claim 16, wherein the linkage assembly comprises a first linkage and a second linkage, the first linkage connected to the valve, the second connected to and between the first linkage and the float.

18. The dishwasher appliance of claim 16, wherein the float is disposed within the filter.

19. The dishwasher appliance of claim 16, wherein the actuator further comprises a weight, the weight slidable along a linkage of the linkage assembly.

20. The dishwasher appliance of claim 11, wherein the valve moves to the first position when a fluid level within the filter is at a first height and moves to the second position when a fluid level within the filter is at a second height that is less than the first height.

* * * * *